US008727350B2

(12) United States Patent
Flynn et al.

(10) Patent No.: US 8,727,350 B2
(45) Date of Patent: May 20, 2014

(54) CARD SHOE

(75) Inventors: Daryl Flynn, Tyngsborough, MA (US); Thomas Haggett, Canterbury, CT (US)

(73) Assignee: Gaming Shoe Company LLC, North Chelmsford, MA (US)

( * ) Notice: Subject to any disclaimer, the term of this patent is extended or adjusted under 35 U.S.C. 154(b) by 0 days.

(21) Appl. No.: 13/411,157

(22) Filed: Mar. 2, 2012

(65) Prior Publication Data

US 2013/0228971 A1 Sep. 5, 2013

(51) Int. Cl.
*A63F 1/12* (2006.01)

(52) U.S. Cl.
USPC ..... 273/149 R

(58) Field of Classification Search
USPC ..... 273/149 R
See application file for complete search history.

(56) References Cited

U.S. PATENT DOCUMENTS 4,377,285 A * 3/1983 Kadlic ..... 273/148 A
4,457,512 A * 7/1984 Stevenson ..... 273/148 A
4,711,371 A 12/1987 Harrigan
4,750,743 A * 6/1988 Nicoletti ..... 273/148 A
5,000,453 A * 3/1991 Stevens et al. ..... 273/149 R
5,374,061 A * 12/1994 Albrecht ..... 273/149 R
6,402,142 B1 * 6/2002 Warren et al. ..... 273/149 R
6,637,622 B1 10/2003 Robinson
8,342,932 B2 * 1/2013 Fleckenstein ..... 463/12
8,348,279 B2 * 1/2013 Burton ..... 273/157 R
8,352,341 B1 * 1/2013 Greenberg et al. ..... 705/35
8,353,513 B2 * 1/2013 Swanson ..... 273/149 R
8,408,550 B2 * 4/2013 Walker ..... 273/149 R
2005/0137005 A1 * 6/2005 Soltys et al. ..... 463/13
2007/0138743 A1 6/2007 Fleckenstein
2007/0216092 A1 * 9/2007 Fleckenstein ..... 273/149 R
2008/0111300 A1 5/2008 Czyzewski et al.
2009/0121429 A1 * 5/2009 Walsh ..... 273/149 R

* cited by examiner

*Primary Examiner* — Kurt Fernstrom
*Assistant Examiner* — Dolores Collins
(74) *Attorney, Agent, or Firm* — Wolf, Greenfield & Sacks, P.C.

(57) ABSTRACT

A card shoe comprising security features. The card shoe may include a housing and a flexible flag to at least partially overlie a front cover and an opening in the front cover. The card shoe may include an opening between a playing card support and a bottom of the front cover sized to allow only one playing card to be withdrawn at one time. The card shoe may include identification tags and areas for advertising. A form of advertising may include light-emitting diodes incorporated into the housing of the card shoe.

17 Claims, 3 Drawing Sheets

FIG. 6e
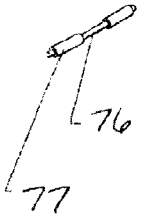
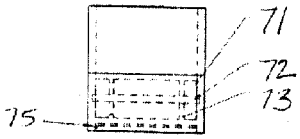
FIG. 6b
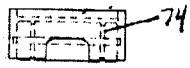
FIG. 6c
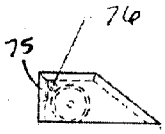
FIG. 6d
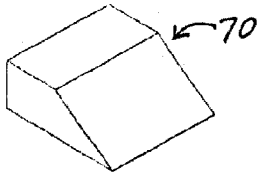
FIG. 6a

CARD SHOE

FIELD

Aspects described herein relate generally to the field of table gaming and more particularly to card holding devices used for the delivery of playing cards.

DESCRIPTION OF THE RELATED ART

Dealers often use card shoes to deliver cards to players in blackjack, poker, baccarat, and other casino table card games. A card shoe typically includes a housing to receive the playing cards and a playing card support surface that supports the playing cards. The playing card support surface is usually sloped at a downward angle from the rear to the front of the housing and a playing card wedge may be positioned behind the playing cards. The housing includes an opening at the front where playing cards are extracted during a playing card game.

Conventional card shoes hold two to eight standard decks of playing cards, with fifty-two playing cards per standard deck. After shuffling, the dealer inserts the playing cards into the card shoe and places a blank colored card into the shuffled decks to mark a position at which approximately one to one and a half decks of cards are present behind the blank colored card. When this blank colored card is drawn during a playing card game, it indicates the last game before reshuffling of the cards.

SUMMARY

The inventors have recognized several security risks related to conventional card shoes. Existing card shoes fail to protect casinos against issues involving the card registration of playing cards. During manufacture, playing cards are printed on large sheets and then cut into individual playing cards. The playing cards may not be cut evenly, and therefore the design or pattern on the back side of a playing card may not be symmetrical. This offset of the design or pattern on a playing card is known as the card registration. A player trained in recognizing the card registration of a playing card may use this skill to predict the next playing card in the card shoe if the player can view the back side of the playing card. According to one aspect, a card shoe is configured to reduce forms of cheating involving a card shoe and players trained to recognize the card registration of playing cards.

The inventors have also recognized that current card shoes may not prevent more than one playing card from coming out of the card shoe at one time. If more than one card can be withdrawn from the card shoe at one time, this may lead to unfair dealing of the cards. According to one aspect, a card shoe is provided which prevents more than one card from being withdrawn at one time.

The inventors have recognized that current card shoes may allow dealers to push the front playing card in the card shoe backwards and up into the card shoe to withdraw the second playing card instead. This is known as "dealing seconds." According to another aspect, a card shoe is provided which helps prevent dealers from dealing seconds.

According to one embodiment, a card shoe includes a housing comprising a playing card support and a front cover comprising an opening and a flexible flag configurable to at least partially overlie the front cover and the opening.

According to another embodiment, a card shoe includes a housing comprising a playing card support and a front cover, and a horizontal gap between the between the playing card support and a bottom of the front cover for withdrawing a playing card, wherein the gap is sized to allow only one playing card to be withdrawn at one time.

According to a further embodiment, a card shoe includes a housing, light emitting diodes incorporated into the housing, and a power source for the light emitting diodes.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 5 is a perspective view of a top cover according to one embodiment;

FIG. 6*a* is a perspective view of a wedge according to one embodiment;

FIG. 6*b* is a top view of the wedge of FIG. 6*a;*

FIG. 6*c* is a back view of the wedge of FIG. 6*a;*

FIG. 6*d* is a side view of the wedge of FIG. 6*a*; and

FIG. 6*e* is a perspective view of a rod of the wedge of FIG. 6*a.*

DETAILED DESCRIPTION

Conventional card shoes for use in table gaming present several security risks to casinos. The inventors have recognized that the security of card shoes can be improved through the incorporation of one or more features described below.

Figures 1, 3, 4, 6:
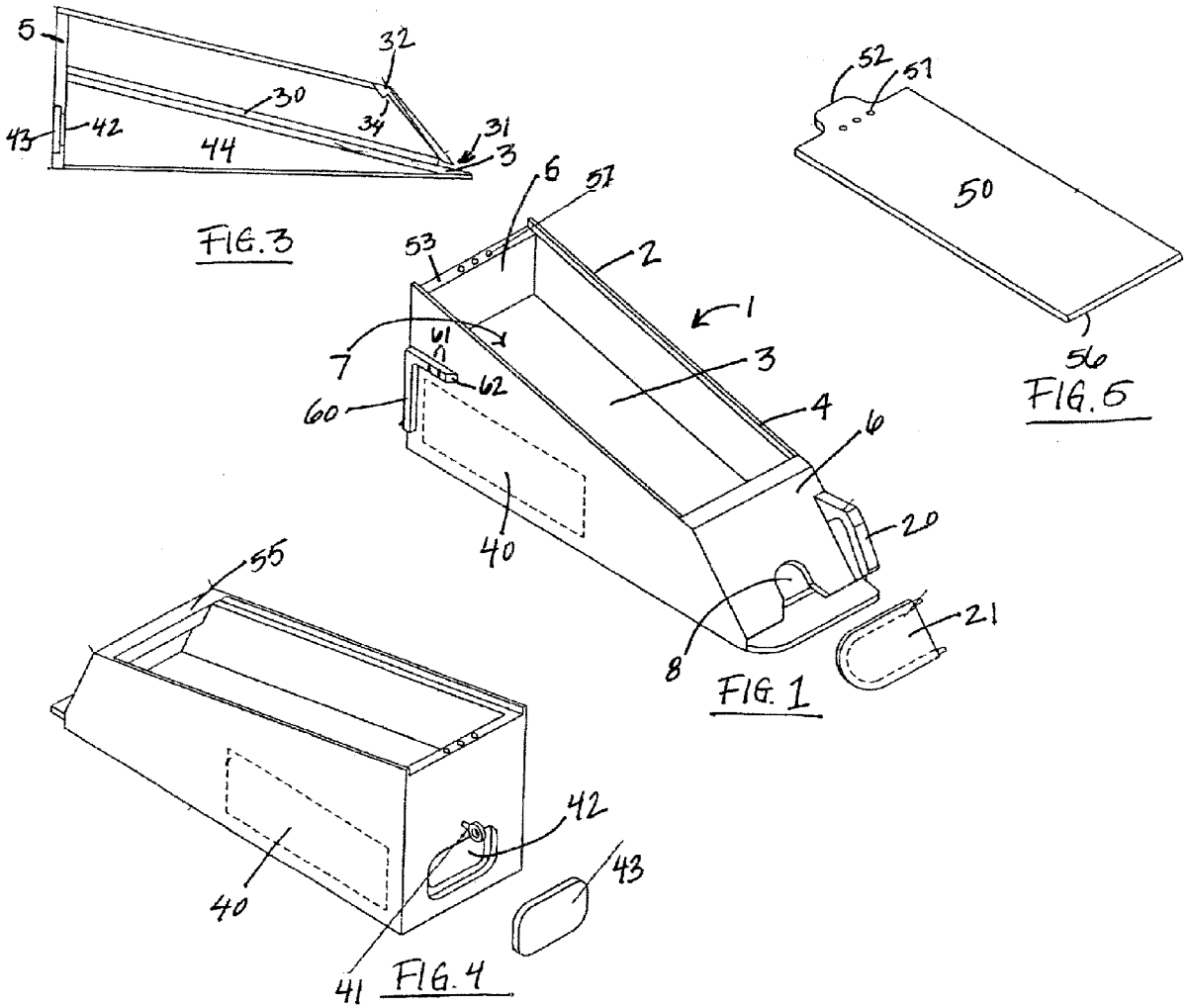
FIG. 1 is a front perspective view of a card shoe according to one embodiment.
FIG. 3 is a cross-sectional view of the card shoe of FIG. 1.
FIG. 4 is a back perspective view of the card shoe of FIG. 1.

FIG. 1 shows a perspective view of a card shoe 1 according to one embodiment. The card shoe 1 has a housing 2 including a playing card support 3, sidewalls 4, a rear wall 5, and a front cover 6. The playing card support, sidewalls, rear wall, and front cover form a vessel 7 into which the playing cards are placed. According to one embodiment, the card shoe may have an overall height of 5.187 inches, an overall length of 13.375 inches, and an overall width of 4.313 inches. Although the embodiment describes defined dimensions, the invention is not limited in this regard and other dimensions suitable may be employed.

The playing card support 3 may be sloped toward the front cover 6. The front cover 6 includes an opening 8 into which a dealer may insert a finger, typically in a sliding motion from the top to the bottom of the front cover, to extract a playing card from the card shoe 1. The front cover 6 is placed at an angle to facilitate the extraction of a playing card. Positioning the playing card surface 3 at approximately a forty-eight degree angle from the horizontal table surface and positioning the front cover 6 at an angle between about 11 degrees and about 13 degrees from the playing card surface 3 provides an advantageous dealing angle. The playing card surface 3 and the front cover 6 may be placed at any angle that allows a dealer to extract a playing card. Although the embodiment describes defined angles, the invention is not limited in this regard and other angles suitable may be employed.

According to one embodiment, the front cover 6 includes a connector 20 which is connectable to a flag 21. The front cover 6 and connector 20 may be formed as one solid piece. Alternatively, the front cover 6 and connector 20 may be formed as two or more separate pieces and subsequently attached by any suitable attaching arrangement (e.g., adhesives, nails, screws, plastic welding). Preferably the connector 20 is arranged to be permanently attached to the front cover 6, but the connector 20 also may be removable from the front cover. The connector 20 may be positioned anywhere on the front cover 6, or alternatively, the connector may be attached to a sidewall 4 or a top cover 50. Preferably the connector 20, from the perspective of a front view of the front cover, is located on the right side of the front cover 6.

Figure 2A:
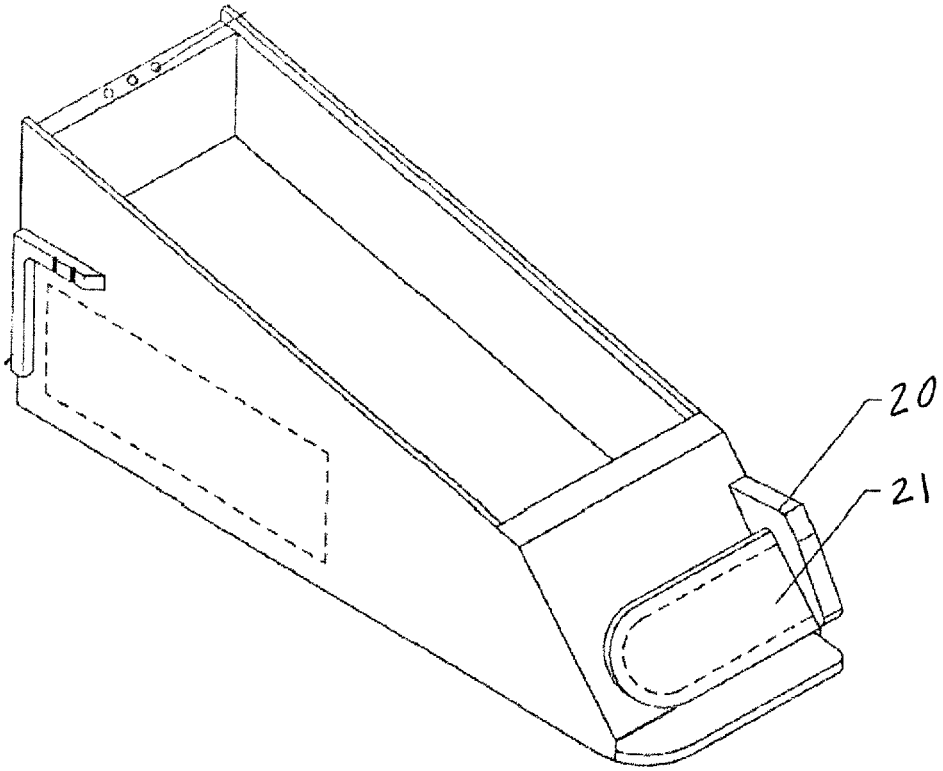
FIG. 2*a* is a front perspective view of the card shoe of FIG. 1 with a flag connected to the card shoe according to one embodiment.

A flag 21 may be attached to the connector 20 that at least partially overlies the front cover 6 and the opening 8. FIG. 2*a* shows a flag 21 attached to a connector 20 according to one embodiment. The flag 21 may act as a blocking device such that players at a gaming table may not view the back of the next card to be drawn from the card shoe through the opening 8 in the front cover 6. The flag 21 may be positioned at a distance from the front cover 6 to allow a dealer's finger to slide between the flag 21 and the front cover 6 when extracting a playing card from the card shoe. The flag may be any shape or size so long as the flag blocks at least a portion of the opening 8 of the front cover 6. Alternatively, the flag 21 may not be attached to the card shoe, but may be attached to the card table or another device and positioned in front of the front cover 6 to cover the opening 8.

Figure 2B:
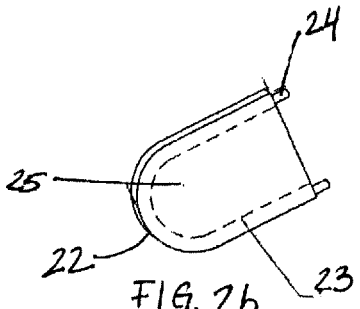
FIG. 2*b* is a perspective view of a flag according to one embodiment.

The flag 21 may be rigid or flexible and may be manufactured from any suitable material, but preferably the flag is comprised of a flexible material such that when a dealer extracts a playing card, the flag may be displaced away from the front cover 6 when the dealer's finger slides between the flag and the front cover. Once the dealer's finger has been removed, the flag 21 may return to its original position. In one embodiment, shown in FIG. 2*b*, the flag may be comprised of a microfiber or other cloth material that is sewn around the inside edge to form a pocket 23 around the majority of the circumference of the flag. In this embodiment, a horseshoe shaped support rod 24 slides through the sewn pocket 23 to form the flag. The rod 24 may be any suitable shape and made of any suitable material. The rod 24 may have two ends that extend beyond the cloth portion of the flag that may be used to insert the flag into corresponding holes of the connector 20. Alternatively, the flag 21 and rod 24 may be formed as one integral piece, such as a solid plastic piece and the flag 21 may be attached to the connector 20 by any means (e.g., pins, snaps, slide-on, adhesives, hinges, etc.). The flag may be attached to the connector 20 permanently, but alternatively, the flag may be removable such that different flags may be attached to the connector at different times. The flag may have a front surface 25 that may be used for advertising or any other marketing purposes. For example, company logos or advertisements may be incorporated on the front surface.

FIG. 3 shows a cross-sectional view of the card shoe according to one embodiment. A gap 31 between the playing card support 3 and the front cover 6 may be configured to allow only one playing card to fit through the gap. A conventional card shoe has a gap that is sufficiently wide to allow two or more cards to fit through the gap. In one embodiment, the gap 31 may be smaller than the thickness of two standard playing cards such that only one card may fit through the gap 31 at one time. In one embodiment, the gap has a thickness ranging from approximately 0.01 inches to approximately 0.02 inches. Although the embodiment describes defined measurements, the invention is not limited in this regard and other measurements suitable may be employed.

In one embodiment the playing card support 3 may be a bottom of the housing. In another embodiment, the playing card support may be a plate 30 arranged to sit on a bottom of the housing to elevate the playing cards above the bottom of the housing. The plate 30 may extend from the rear wall 5 to the front cover 6, providing a continuous surface on which the cards move from the rear to the front of the card shoe. The plate may extend completely between the sidewalls 4 as one continuous piece, or alternatively, the plate may comprise one or more partial plates such that the bottom of the housing may be exposed between the one or more partial plates. The plate 30, along with the small gap 31, may further prevent a dealer from pushing a playing card back into the card shoe.

The front cover 6 may include a protruding ridge 32 at the top of the front cover 6 that extends at least partially along the width of the front cover. The protruding ridge 32 may be positioned from the gap 31 at a distance that is slightly larger than the width of a standard playing card, and the protruding ridge 32 may have a surface 34 that is larger than the thickness of a standard playing card. In one embodiment the protruding edge 32 is approximately 2.62 inches from the gap 31. In the event a dealer attempts to push a playing card back and up into the card shoe, the playing card will catch on the surface 34 of the protruding ridge 32 which will prohibit the playing card from moving backward away from the opening, thereby preventing a dealer from dealing seconds, as discussed above. Although the embodiment describes defined measurements, the invention is not limited in this regard and other measurements suitable may be employed.

According to one embodiment shown in FIGS. 1 and 4, the housing may include at least one area 40 configured for personalizing the card shoe or providing custom logos or advertising, which may be incorporated into the housing by any means (e.g., screen printing, engraving, laser etching, stickers, light-emitting diodes). In one embodiment, light-emitting diodes (LED) may be incorporated in the area 40 to provide lighted signs. The LEDs may be powered by battery or by an external power supply. Although the area 40 is shown on a side wall in FIGS. 1 and 4, the area 40 may be located on any part of the housing.

The card shoe may comprise an opening 42 in the rear wall 5 and a transparent window 43 arranged to fit into the opening 42. A casino may wish to place an identifier into the open space 44 beneath the playing card support 3 that will identify the card shoe as an official card shoe belonging to the casino. A security guard or other casino employee may easily view the identifier through the transparent window 43. The transparent window 43 may be removable, but preferably the window is permanently affixed to the card shoe to prevent tampering with the identifier. The transparent window 43 may be supplied to casinos separately or already affixed to the card shoe, provided that the casino or customer previously provided the identifier to be placed into the open space 44 before affixing the transparent window 43.

The card shoe also may include a hook 41 on which to attach a chain or cord to secure the card shoe to the gaming table. In one embodiment, the hook 41 may be located in the rear wall 5, but it may be placed anywhere on the card shoe. The card shoe may further comprise a card cut gauge 60 positioned on a side wall 4 near the rear of the card shoe. The card cut gauge 60 may be a in the shape of an upside-down "L" and may have tabs 61 that aid a dealer in placing the blank colored card into the shuffled playing cards, as discussed above. For example, one tab may mark the distance from the rear of the card shoe of the length of one standard deck of playing cards, a second tab may mark the length of a deck and a half, and the end of the card cut gauge 62 may mark the length of two decks.

The card shoe may comprise a top cover 50, one example of which is shown in FIG. 5, as a security feature to prevent players from viewing the location of the blank colored card. The top cover 50 may be positioned between the sidewalls 4 in a recess 54 provided along the top of the side walls that coincides with the top surface 53 of the rear wall. The top cover may fit into the recess and then may be slid toward the front of the card shoe. The top cover may include a front arrow head design 56 configured to sit beneath a top section 55 of the front cover 6, allowing the front cover 6 to catch the top cover 50 and secure the top cover into place. The top cover 50 and the rear wall 5 may each comprise at least one magnet 57 that cooperate to hold the top cover 50 to the housing 2. The top cover also may include a tab 52 arranged at the rear of the top cover that facilitates removal of the top cover by allowing a user to grip the tab and lift the top cover off the housing 2.

The card shoe may include an improved wedge 70, as shown in FIGS. 6*a*-6*e*, that sits on the card support surface 3, 30 behind the playing cards. The wedge 70 may have an angled front surface to offset the playing cards relative to one another. The wedge 70 may include a transverse roller 71 connected to the wedge by an axle 72. The roller 71 and the axle 72 may be comprised of steel or any other suitable material. The roller may comprise at least one groove 73 capable of receiving an o-ring 74. The wedge 70 may also include a transverse rod 76 that may comprise tubing 77 (e.g., tygon tubing) positioned in the top back corner of the wedge that is arranged to serve as a braking mechanism. The rod 76 may be an acrylic rod or made of any other suitable material. The roller 71 and the rod 76 may be arranged in parallel in the wedge 60 and the roller 71 may be connectable to the rod 76. In one embodiment, the roller 71 may be connectable to the rod such that the tubing 77 of the rod 76 contacts at least one o-ring 74 of the roller 71. The roller 71 also may be arranged such that at least one o-ring 74 makes contact with the top surface of the card support surface 3, 30 through an opening in the bottom of the wedge 70 when the wedge is placed in the card shoe. As a result, when the wedge moves in a forward direction toward the front of the card shoe, the roller 71 rotates in a clock-wise direction (FIG. 6*d*), engaging the rod 76 and moving the rod 76 toward the top of the wedge. There may be sufficient space between the rod 76 and the top of the wedge such that the rod 76 may rotate freely, allowing the roller 71 to rotate and the wedge to move forward.

In the event the wedge is pushed back toward the rear of the card shoe, the roller 71 rotates in a counter-clockwise direction, engaging the rod 76 and moving the rod down and back toward the rear wall of the wedge. An inside surface of the rear wall may include a friction surface 75 to engage the rod 76. When the rod 76 is compressed against the rear wall, the friction surface may stick to the rod 76 and prevent the rod from rotating, which then in turn would prevent the roller 71 from rotating and the wedge from moving backwards. As a result, the roller 71 may only be movable in one direction toward the front opening of the card shoe. In the event a dealer exerts a rearward force on the front playing card in an attempt to extract the card behind the front card, the wedge counters the force and prohibits the playing cards from moving back away from the opening. As such, a wedge 70 movable only in one direction toward the opening of the card shoe may inhibit a dealer from dealing seconds.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the foregoing description and drawings are by way of example only.

What is claimed is:

1. A card shoe comprising:

a housing comprising a playing card support and a front cover comprising an opening; and a displaceable flag positioned at a distance from the front cover, the flag configurable to at least partially overlie the front cover and the opening for blocking from view the back of the card to be drawn from the card shoe;

wherein the flag is biased in a blocking position; and wherein the flag has a shape, the shape being maintained to allow the flag to block from view the back of the card.

2. The device of claim 1 further comprising a connector attached to the housing, wherein the flag is connected to the connector.

3. The device of claim 2 wherein the flag is removable from the connector.

4. The device of claim 1 wherein the flag includes advertising.

5. The device of claim 1 further comprising a plurality of interchangeable flags.

6. The device of claim 1 wherein the flag comprises a cloth material including a peripheral pocket and a support rod insertable into the peripheral pocket.

7. The device of claim 1 further comprising a horizontal gap between the playing card support and a bottom of the front cover for withdrawing a playing card, wherein the gap is sized to allow only one playing card to be withdrawn at one time.

8. The device of claim 7 further comprising light emitting diodes incorporated into the housing and a power source for the light emitting diodes.

9. The device of claim 1 further comprising light emitting diodes incorporated into the housing and a power source for the light emitting diodes.

10. The card shoe of claim 1, wherein the flag is substantially rigid.

11. A card shoe comprising:

a housing comprising a playing card support and a front cover comprising an opening;

a horizontal gap between the playing card support and a bottom of the front cover for withdrawing a playing card, the gap being sized to allow only one playing card to be withdrawn at one time; and a displaceable flag positioned at a distance from the front cover, the flag configured to at least partially overlie the front cover and the opening for blocking from view the back of the card to be drawn from the card shoe, the flag having a shape, the shape being maintained to allow the flag to block from view the back of the card.

12. The card shoe of claim 11, wherein the flag is substantially rigid.

13. The card shoe of claim 11, wherein the flag is flexible.

14. The card shoe of claim 11, further comprising a connector attached to the housing, wherein the flag is connected to the connector.

15. The device of claim 14, wherein the flag is removable from the connector.

16. The card shoe of claim 11, wherein the flag comprises a cloth material including a peripheral pocket and a support rod insertable into the peripheral pocket.

17. The card shoe of claim 11, wherein the flag is biased in a blocking position.

* * * * *